US008109053B2

(12) United States Patent
Smith

(10) Patent No.: US 8,109,053 B2
(45) **Date of Patent: *Feb. 7, 2012**

(54) DOOR FRAME ASSEMBLY

(75) Inventor: M. Stephen Smith, Milan, TN (US)

(73) Assignee: Assa Abloy Door Group, LLC, New Haven, CT (US)

( * ) Notice: Subject to any disclaimer, the term of this patent is extended or adjusted under 35 U.S.C. 154(b) by 68 days.

This patent is subject to a terminal disclaimer.

(21) Appl. No.: 12/623,923

(22) Filed: Nov. 23, 2009

(65) Prior Publication Data

US 2010/0083598 A1 Apr. 8, 2010

Related U.S. Application Data

(63) Continuation of application No. 11/143,291, filed on Jun. 1, 2005, now Pat. No. 7,621,083.

(51) Int. Cl.
*E06B 1/04* (2006.01)

(52) U.S. Cl. ..... 52/212; 49/504; 52/211

(58) Field of Classification Search ..... 52/204.1, 52/204.2, 205–207, 210–213, 215–217, 656.4, 52/656.6; 49/504
See application file for complete search history.

(56) References Cited

U.S. PATENT DOCUMENTS

| | | | |
|---|---|---|---|
| 1,150,790 | A | 8/1915 | Swanson |
| 1,266,547 | A | 5/1918 | Baxter |
| 1,806,647 | A | 5/1931 | Rose |
| 1,995,764 | A | 3/1935 | Boshnack |
| 2,052,121 | A | 8/1936 | Venzie |
| 2,755,895 | A | 7/1956 | Walterman et al. |
| 2,799,370 | A | 7/1957 | Samuel |
| 3,287,857 | A | 11/1966 | John |
| 3,420,003 | A | 1/1969 | Cline |
| 3,469,350 | A | 9/1969 | Lange |
| 3,566,563 | A | 3/1971 | Ruff |
| 3,721,055 | A | 3/1973 | Jerchower |
| 3,861,099 | A | 1/1975 | Faudree |
| 3,906,671 | A | 9/1975 | Maldonado |
| 4,034,514 | A | 7/1977 | Cecil |
| 4,126,975 | A | 11/1978 | Williams |
| 4,179,849 | A | 12/1979 | Kuffner |
| 4,308,692 | A | 1/1982 | Rumble et al. |
| 4,674,248 | A | 6/1987 | Hall |
| 4,698,944 | A | 10/1987 | Wilkins, Jr. |
| 4,791,758 | A | 12/1988 | Bauer et al. |
| 4,819,392 | A | 4/1989 | Day |
| 4,873,804 | A | 10/1989 | Kukke |
| 4,878,325 | A | 11/1989 | Van Tuyl et al. |

(Continued)

*Primary Examiner* — Katherine Mitchell
*Assistant Examiner* — Catherine A Kelly
(74) *Attorney, Agent, or Firm* — Wiggin and Dana LLP; Anthony P. Gangemi

(57) ABSTRACT

A welded door frame assembly including a hinge jamb joined to a lock jamb via a frame head jamb, all of which are joined with existing studs and an existing wall. The hinge jamb has a bottom end and a top end and includes a door side base, a door contact flange, and a non-door side trim attachment track including one or more fastener holes. A hinge jamb trim piece includes a connector portion configured to be removably retained within the non-door side trim attachment track and is adapted to cover the non-door side trim attachment track, any fastener holes, and any fasteners. Both the lock jamb and frame head jamb include a door side base, a door contact flange, and a connection flange including one or more fastener holes. A lock jamb or frame head jamb trim piece covers the connection flange, any fastener holes, and any fasteners.

12 Claims, 5 Drawing Sheets

U.S. PATENT DOCUMENTS

| | | | | |
|---|---|---|---|---|
| 4,912,879 | A | 4/1990 | Mozuras et al. | |
| 4,986,034 | A | 1/1991 | Mozuras et al. | |
| 5,070,651 | A | 12/1991 | Jeter | |
| 5,154,019 | A | 10/1992 | Day | |
| 5,216,856 | A | 6/1993 | Schroeder | |
| 5,233,802 | A | 8/1993 | Rogers | |
| 5,365,697 | A | 11/1994 | Vanderpan | |
| 5,575,123 | A | 11/1996 | Adams | |
| 5,613,324 | A | 3/1997 | Theune | |
| 5,619,823 | A | 4/1997 | Ruff et al. | |
| 5,711,120 | A | 1/1998 | Karpen | |
| 5,735,326 | A | 4/1998 | Seidner | |
| 5,787,660 | A | 8/1998 | Adams | |
| 5,901,511 | A | 5/1999 | Yoshida | |
| 5,934,030 | A | 8/1999 | McDonald | |
| 5,974,745 | A | 11/1999 | Barr | |
| 5,979,129 | A | 11/1999 | Azar | |
| 6,282,851 | B1 | 9/2001 | Beaton | |
| 6,286,274 | B1 | 9/2001 | McKann | |
| 6,405,506 | B2 | 6/2002 | Ruff | |
| 6,550,193 | B2 | 4/2003 | Potts | |
| 6,557,309 | B1 | 5/2003 | Johnson | |
| 6,705,047 | B2 | 3/2004 | Yulkowski | |
| 7,104,016 | B2 | 9/2006 | Kerr | |
| 7,174,691 | B2 | 2/2007 | de Garay Arellano | |
| 7,621,083 | B2 * | 11/2009 | Smith | 52/212 |
| 2001/0001918 | A1 | 5/2001 | Ruff | |
| 2002/0112420 | A1 | 8/2002 | Phomphakdy et al. | |
| 2002/0166299 | A1 | 11/2002 | Day | |
| 2003/0046886 | A1 | 3/2003 | Potts | |
| 2004/0083678 | A1 | 5/2004 | Tumlin et al. | |
| 2004/0226232 | A1 | 11/2004 | Engebretson | |
| 2004/0250486 | A1 | 12/2004 | Sibbett | |
| 2005/0097839 | A1 | 5/2005 | Kerscher | |
| 2005/0193652 | A1 | 9/2005 | Cornell | |
| 2005/0193653 | A1 | 9/2005 | Cornell | |
| 2006/0005481 | A1 | 1/2006 | Ouellette | |
| 2006/0048466 | A1 | 3/2006 | Darnell | |
| 2006/0096191 | A1 | 5/2006 | Liu | |
| 2006/0254163 | A1 | 11/2006 | Vidal | |

* cited by examiner

DOOR FRAME ASSEMBLY

CROSS-REFERENCE TO RELATED APPLICATIONS

The present application is a continuation of pending U.S. application Ser. No. 11/143,291, filed Jun. 1, 2005, which is incorporated by reference as if disclosed herein in their entirety.

BACKGROUND OF THE INVENTION (1) Field of the Invention

The present invention generally relates to a door frame assembly. In particular, the present invention is directed to a door frame assembly that may be installed after the wall and door opening is finished.

(2) Description of the Related Art

Existing door frame assemblies, i.e., frames, doors, and hardware, are typically supplied separately in multiple shipments and assembled on site. The process often involves problems with coordination, quality alignment, and missing components.

In commercial applications, hollow metal frames generally must be supplied in advance of wall construction and must be installed prior to wall completion. If delivery of the hollow metal frames is delayed, the overall construction schedule will be impacted as the completion of the walls will be delayed too.

Known door frame assemblies that may be installed post-drywall typically include knock-down frames and therefore cannot be shipped with pre-hung doors. Other known door frame assemblies require finish work such as taping, sanding, and painting and or the attachment of trim after the assembly is installed. Existing door frame assemblies take as much as 1-2 hours to install.

BRIEF SUMMARY OF THE INVENTION

One aspect of the present invention is a door frame assembly for installation with existing studs and walls. The door frame assembly includes a hinge jamb having a bottom end and a top end. The hinge jamb further includes a door side base connected to a door contact flange, which is connected to a non-door side trim attachment track. The non-door side trim attachment track is adapted to be fastened to the existing studs. A hinge jamb trim piece includes a connector portion configured to be removably retained within the non-door side trim attachment track. The hinge jamb trim piece is adapted to at least partially cover the non-door side trim attachment track and any fasteners. A lock jamb includes a bottom end and a top end and further includes a door side base connected to a door contact flange, which is connected to a connection flange, the connection flange adapted to be fastened to the existing studs. A lock jamb trim piece is adapted to at least partially cover the connection flange and any fasteners. A frame head jamb includes a hinge jamb end and a lock jamb end. The hinge jamb end is joined with the top end of the hinge jamb and the lock jamb end is joined with the top end of the lock jamb. The frame head jamb further includes a door side base connected to a door contact flange, which is connected to a connection flange, the connection flange adapted to be fastened to the existing studs. A frame head jamb trim piece is adapted to at least partially cover the connection flange and any fasteners.

Another aspect of the invention is a door frame assembly for installation with existing studs and walls, which includes a hinge jamb adapted to be joined with the existing studs and overlay the existing walls. The hinge jamb has a bottom end and a top end and further includes a door side base connected to a door contact flange, which is connected to a non-door side trim attachment track. The non-door side trim attachment track includes one or more fastener holes and is adapted to be fastened to the existing studs. A hinge jamb trim piece is adapted to overlay the existing walls. The hinge jamb trim piece includes a connector portion configured to be removably retained within the non-door side trim attachment track. The hinge jamb trim piece is adapted to at least partially cover the non-door side trim attachment track, the one or more fastener holes, and any fasteners. A lock jamb is adapted to be joined with the existing studs and overlay the existing walls. The lock jamb includes a door side base connected to a door contact flange, which is connected to a connection flange. The connection flange includes one or more fastener holes and the connection flange is adapted to be fastened to the existing studs. A lock jamb trim piece is adapted to overlay the existing walls and to at least partially cover the connection flange, the one or more fastener holes, and any fasteners. A frame head jamb is adapted to be joined with the existing studs and overlay the existing walls. The frame head jamb includes a hinge jamb end and a lock jamb end. The hinge jamb end is joined with the top end of the hinge jamb and the lock jamb end is joined with the top end of the lock jamb. The frame head jamb further includes a door side base connected to a door contact flange, which is connected to a connection flange. The connection flange includes one or more fastener holes and is adapted to be fastened to the existing studs. A frame head jamb trim piece is adapted to overlay the existing walls and to at least partially cover the connection flange, the one or more fastener holes, and any fasteners. A trim attachment bracket is sized to fit within at least one of the lock jamb and the frame head jamb and configured to removably secure at least one of the lock jamb trim piece to the lock jamb and the frame head jamb trim piece to the frame head jamb.

BRIEF DESCRIPTION OF THE DRAWINGS

For the purpose of illustrating the invention, the drawings show a form of the invention that is presently preferred. However, it should be understood that the present invention is not limited to the precise arrangements and instrumentalities shown in the drawings, wherein.

DETAILED DESCRIPTION

Figure 1:
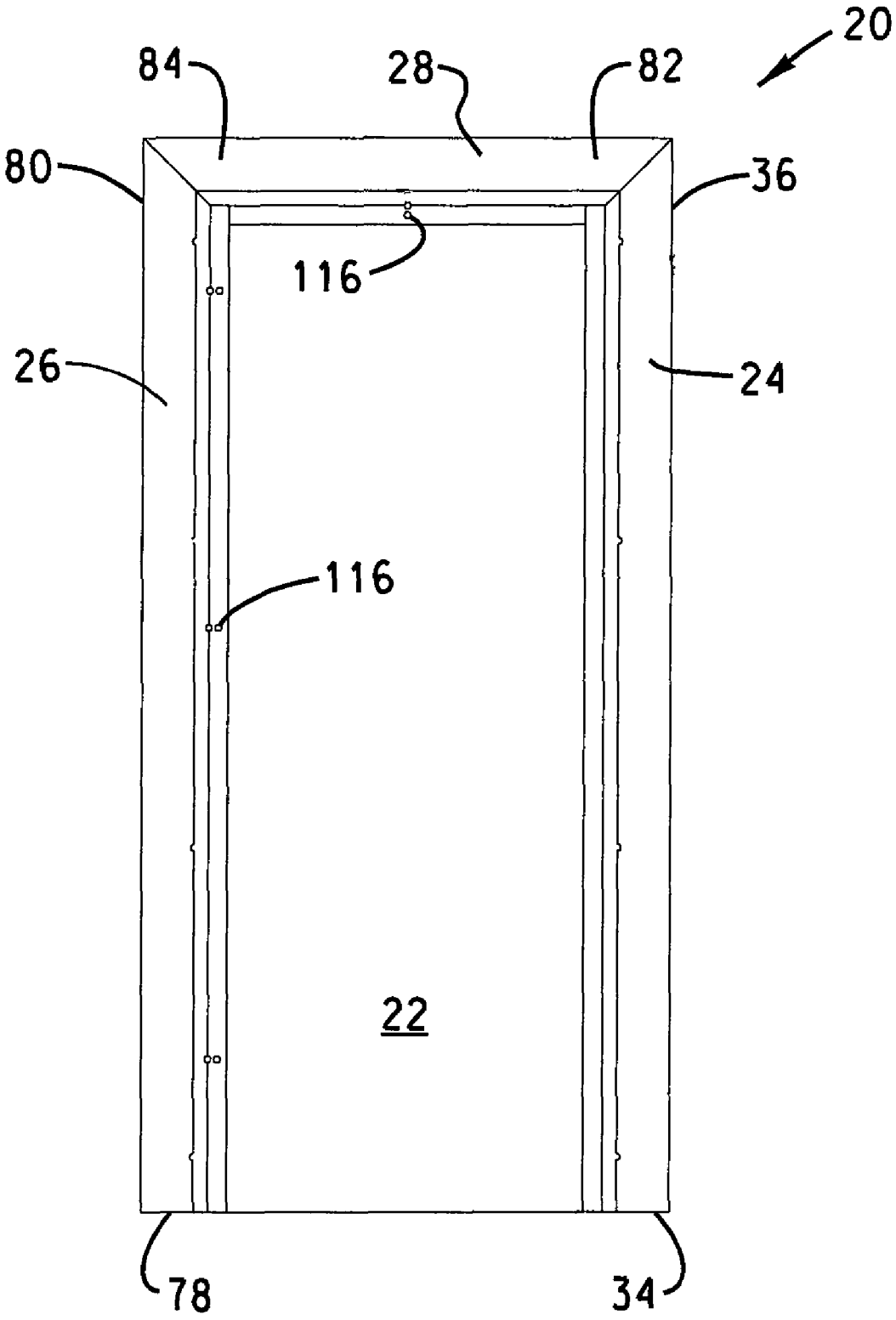
FIG. 1 is a front view of a door frame assembly according to one embodiment of the present invention.

Referring now to the drawings in which like reference numerals indicate like parts, and in particular to FIGS. 1-4, the present invention is a door frame assembly 20 that may be installed post-drywall or after a wall and door opening or doorway 22 has been finished. In one embodiment, door frame assembly 20 includes a hinge jamb 24 joined to a lock jamb 26 via a frame head jamb 28, all of which are joined with existing studs 30-32 and an existing wall 33.

Figure 2:
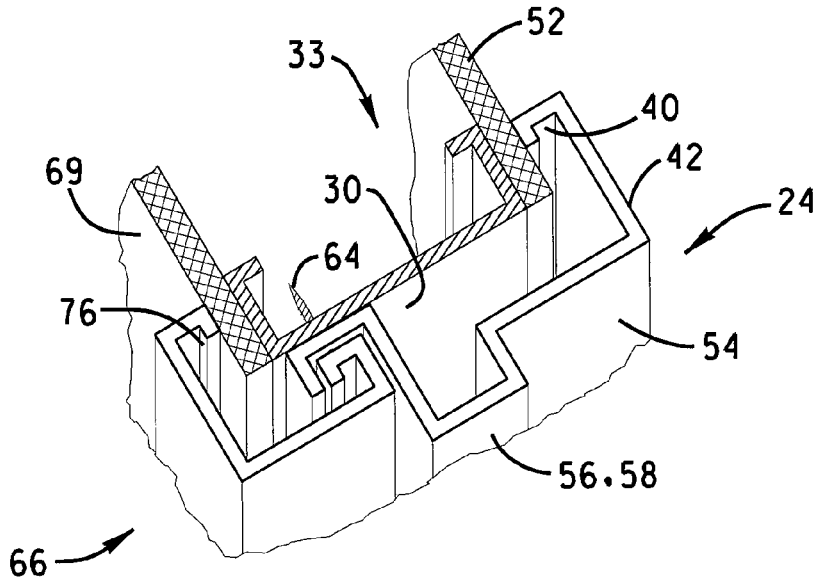
FIG. 2 is a partial cross-sectional view of a hinge jamb according to one embodiment of the present invention.
Figure 3:
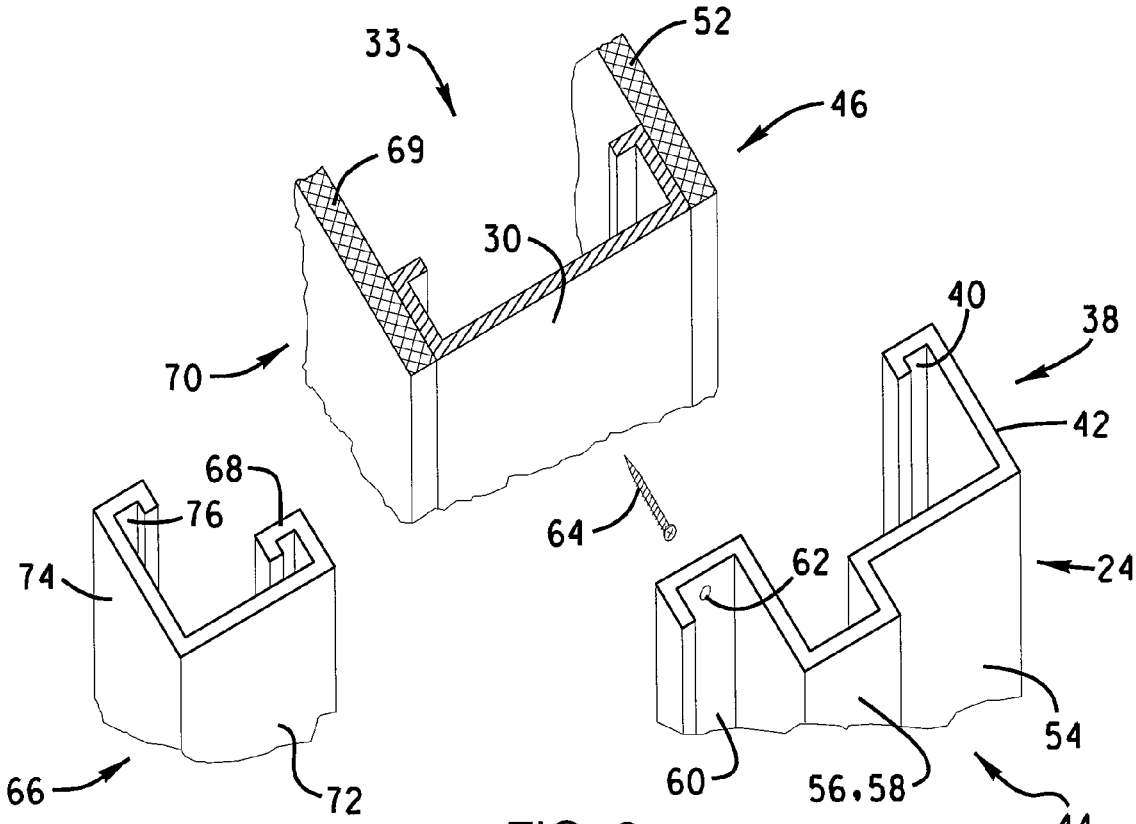
FIG. 3 is an exploded view of the hinge jamb illustrated in FIG. 2.
Figure 4:
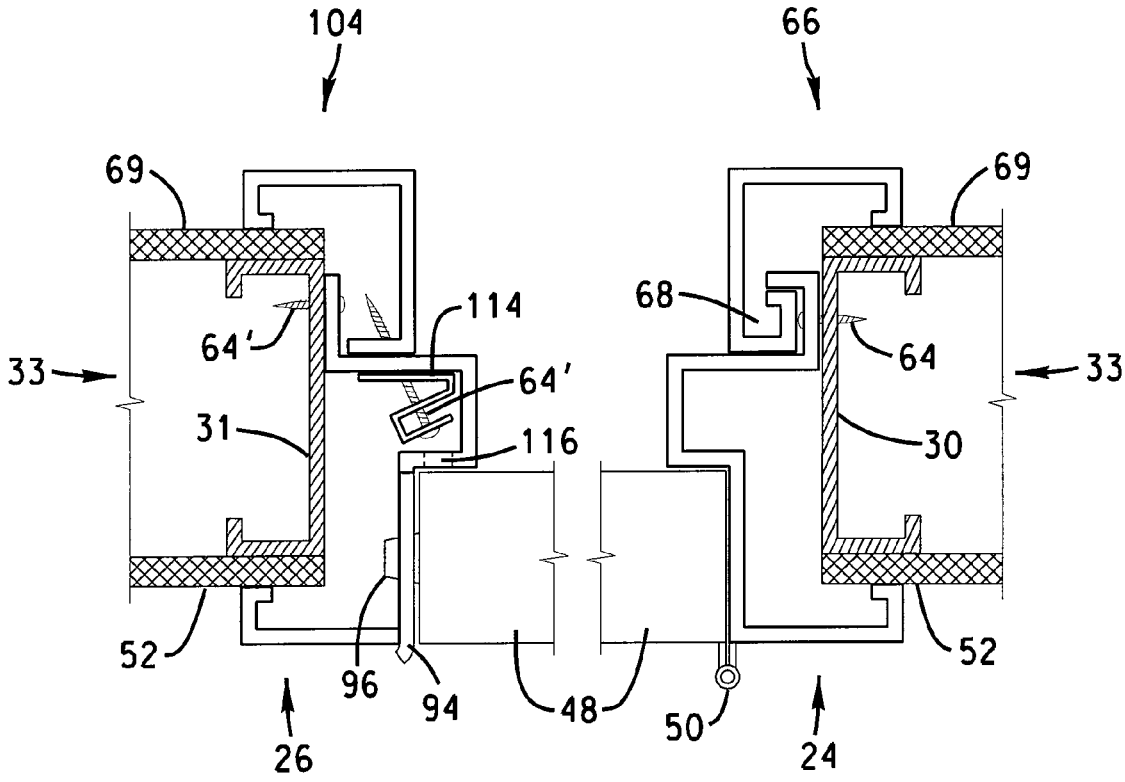
FIG. 4 is a top view cross-sectional of a door frame assembly according to one embodiment of the present invention.

Hinge jamb 24, which is typically formed from a contiguous metal extrusion, includes a bottom end 34 and a top end 36. As best illustrated in FIGS. 2-4, in one embodiment and starting at one edge of hinge jamb 24, the hinge jamb has a contiguous door side base 38 including a wall contact portion 40 joined with an outer surface portion 42, which is joined to an inner surface portion 44. Wall contact portion 40 forms a portion of the outer perimeter of door frame assembly 20 on a door side 46 of wall 33, which is the side of doorway 22 that houses a door 48 and hinges 50 of the doorway, and contacts an existing wall board or drywall 52. Inner surface portion 44 includes a flat portion 54 and a raised portion 56, both of which are positioned within doorway 22. Hinges 50 are joined with flat portion 54. Raised portion 56 forms a door contact flange 58. Door 48 may be sealed against door contact flange 58 when the door is closed. Door contact flange 58 is connected with a non-door side trim attachment track 60, which may include one or more fastener holes 62 through which fasteners such as screws 64 or nails are passed to join hinge jamb 22 to existing stud 30.

A hinge jamb trim piece 66, which is also typically formed from a contiguous metal extrusion, includes a connector portion 68 configured to be to removably retained in non-door side trim attachment track 60 via a snap-fit or similar arrangement and wrap around to overlay an existing wall board or drywall 69, which is on a non-door side 70 of wall 33. While retained within non-door side trim attachment track 60, hinge jamb trim piece 66 covers the non-door side trim attachment track, including fastener holes 62, and any fasteners such as screws 64. Continuing outwardly toward non-door side 70, hinge jamb trim piece 66 also includes a flat inner surface portion 72, which is joined with an outer surface portion 74 and a wall contact portion 76. Wall contact portion 76 forms the outer perimeter of door frame assembly 20 on non-door side 70 of wall 33, which is the side of doorway 22 that does not house door 48 and hinges 50, and contacts existing drywall 66.

Figure 5:
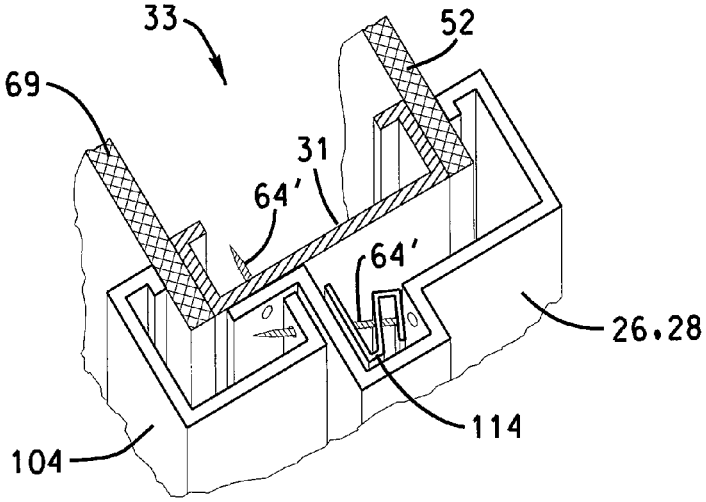
FIG. 5 is a partial cross-sectional view of a lock jamb or frame head jamb according to one embodiment of the present invention.
Figure 6:
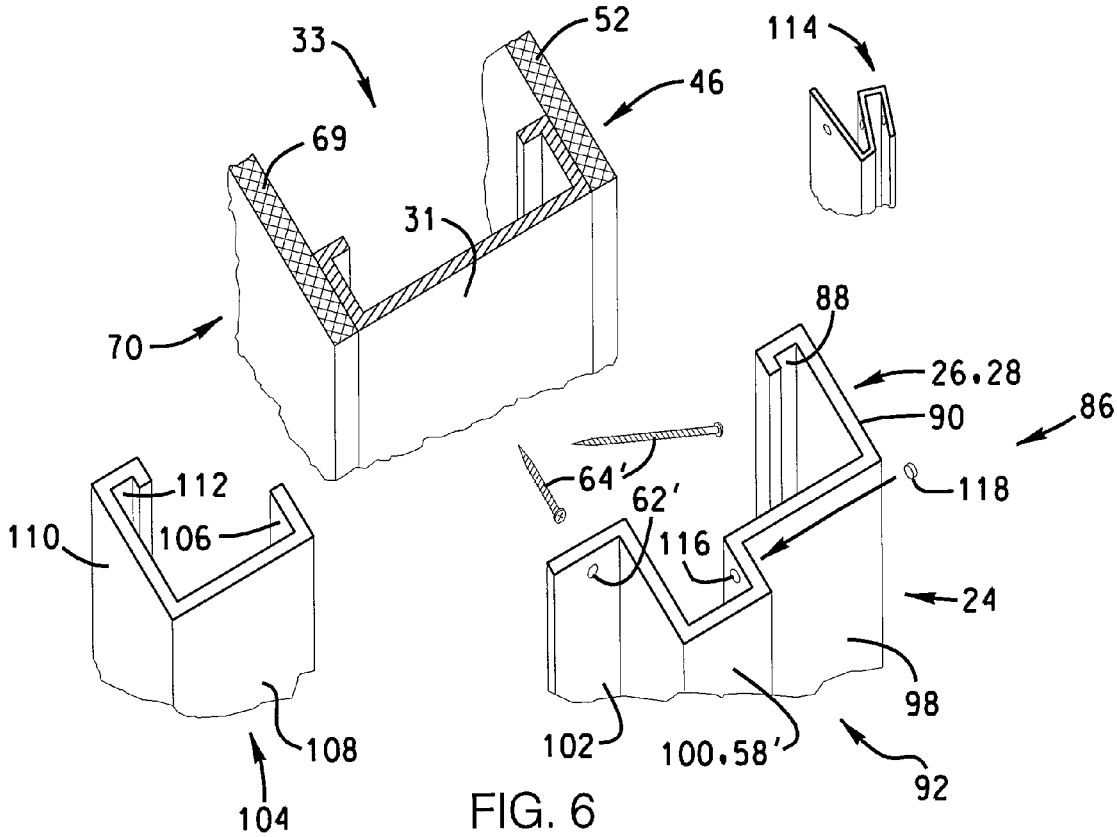
FIG. 6 is an exploded view of the lock jamb or frame head jamb illustrated in FIG. 5.
Figure 7:
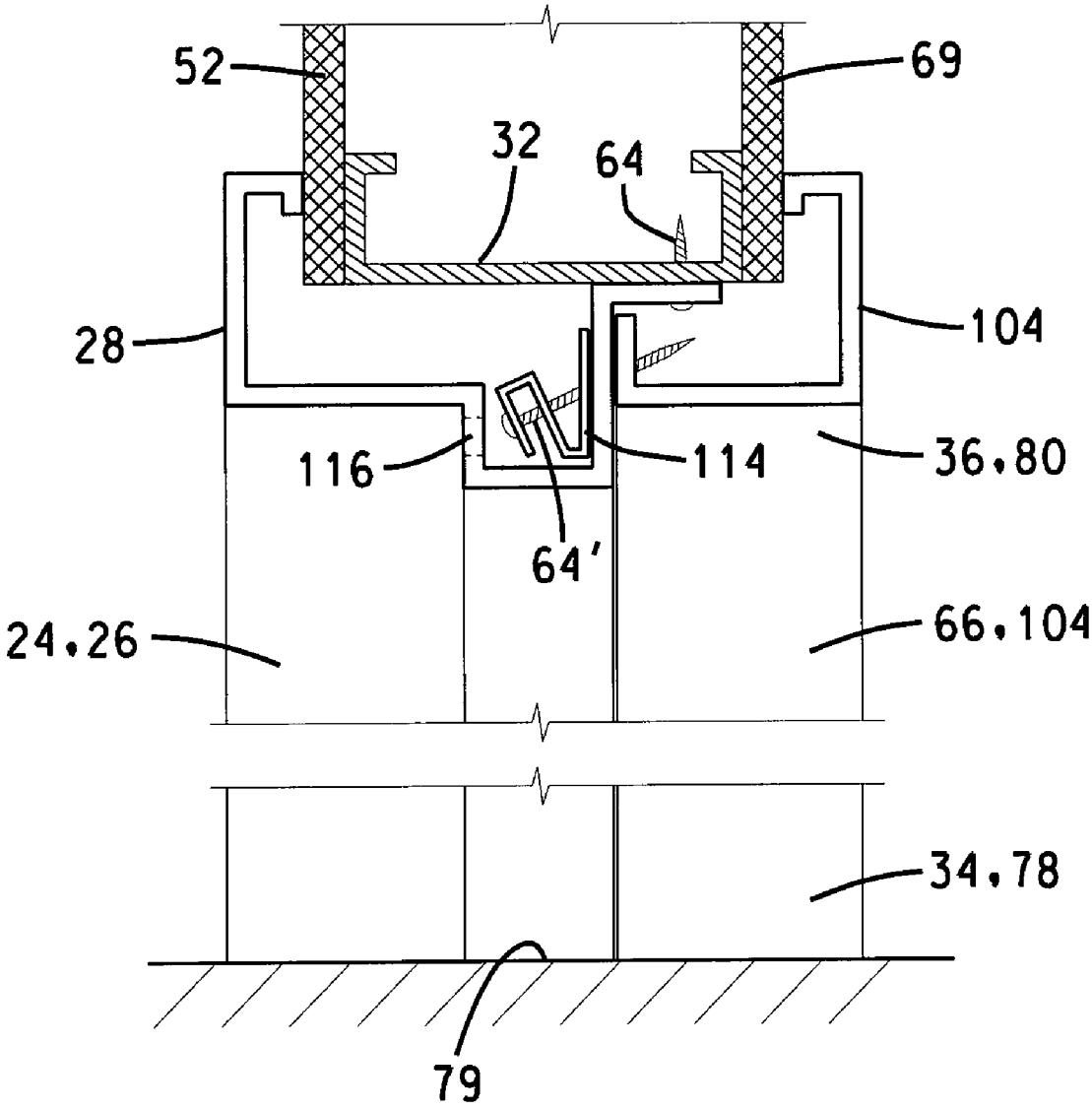
FIG. 7 is a partial elevation cross-sectional view of a door frame assembly according to one embodiment of the present invention.

Now referring to FIGS. 5-7, door frame assembly 20 also includes lock jamb 26 and frame head jamb 28. Lock jamb 26, which is positioned opposite hinge jamb 24 in doorway 22, is joined with existing stud 31 and overlays existing wall 33. Lock jamb 26 includes a bottom end 78, which is adjacent to a threshold or floor 79, and a top end 80. Frame head jamb 28 includes a hinge jamb end 82 and a lock jamb end 84 and is positioned between hinge jamb 24 and lock jamb 26, with hinge jamb end 82 in contact with top end 36 of the hinge jamb and hinge jamb end 84 in contact with top end 80 of the lock jamb.

Lock jamb 26 and frame head jamb 28 are typically formed from identical contiguous metal extrusions. Accordingly, the following description of the extrusions forming jambs 26 and 28 is combined. Starting at the edge positioned on door side 46 of wall 33, each of jambs 26 and 28 has a door side base 86 including a wall contact portion 88 joined with an outer surface portion 90, which is joined with an inner surface portion 92. Wall contact portion 88 forms a portion of the outer perimeter of door frame assembly 20 on a door side 46 of wall 33, which is the side of doorway 22 that houses door 48, hinges 50, and a strike plate 94 for receiving a latchbolt or deadbolt 96 of the lock (not shown), and contacts existing drywall 52. Inner surface portion 92 includes a flat portion 98 and a raised portion 100, both of which are positioned within doorway 22. Strike plate 94 is joined with flat portion 98. Raised portion 100 forms a door contact flange 58'. Door 48 may be sealed against door contact flange 58' when the door is closed. Door contact flange 58' is connected with a connection flange 102, which may include one or more fastener holes 62' through which fasteners such as screws 64' or nails are passed to join either of jamb 24 or 26 to respective existing stud 31 or 32.

Both lock jamb trim piece 104 and frame head jamb trim piece 104, which are typically formed from identical contiguous metal extrusions, include an overlap portion 106 configured to overlap connection flange 102 and be positioned adjacent door contact flange 58'. Overlap portion 106 covers connection flange 102, including fastener holes 62', and any fasteners such as screws 64'. Continuing outwardly toward non-door side 70, lock jamb trim piece 104 also includes a flat inner surface portion 108, which is joined with an outer surface portion 110 and a wall contact portion 112. Lock jamb trim piece 104 wraps around to overlay drywall 69, which is on non-door side 70 of wall 33.

In one embodiment, a trim attachment bracket 114, which is sized to fit within lock jamb 26 and frame head jamb 28, removably secures a respective trim piece 104 to each jamb by acting as a vehicle for a fastener such as a screw 64', which binds the trim piece to the jamb. The fastener is introduced to trim attachment bracket 114 and ultimately both jamb 26 or 28 and trim piece 104 via a mute hole 116 in door contact flange 58'. Mute hole 116 is typically plugged with a rubber mute 118 after the fastener is introduced to trim attachment bracket 114. As one skilled in the art will appreciate, any other known method or device may be used to bind trim piece 104 to jamb 26 or 28.

Door frame assembly 20 is typically installed as a turnkey unit with door 48 and hinges 50 attached to flat portion 54 of door side base 38. To install, door side base 38, including door 48, is positioned in door opening or doorway 22 by sliding it into the opening from the door side, i.e., the side of the assembly the door will swing from. Door frame assembly 20 is typically shipped with a temporary spreader bar (not shown). The temporary spreader bar is generally not removed until door frame assembly 20 is plumb and square.

Next, hinge jamb 24 is plumbed and squared. Typically, top end 36 of hinge jamb 24 must be moved slightly in the direction of the hinge jamb due to the weight of door 48 pulling toward lock jamb 26. Hinge jamb 24 is typically moved by adjusting a top plumb anchor (not shown) on lock jamb 26 and a lower plumb anchor (not shown) on hinge jamb 24 to plumb the hinge jamb. The plumb anchors are typically adjusted by turning adjustment screws via access holes. After hinge jamb 24 is plumb, a plurality of sheet metal attachment screws 64 are run through fastener holes 62 and into existing stud 30, thereby attaching the hinge jamb with the existing stud. Because screws 64 are for additional structural stability only, it is not required that they be tightened enough so that hinge jamb 24 is in contact with existing stud 30. To finalize installation of hinge jamb 24, additional screws known as sill screws (not shown) are generally run through additional fastener holes 62 adjacent bottom end 34 of the hinge jamb and into existing stud 30. Next, lock jamb 26 is checked for plumbness and squareness. If required, adjustments are made using the plumb anchors (not shown) and/or raising lock jamb 26. Once lock jamb 26 is plumb, the lock jamb is secured to existing stud 30 by running sheet metal screws 64' through fastener holes 62' on connection flange 102 into the existing stud. In addition, sill screws (not shown) are also run through fastener holes 62' adjacent bottom end 78 of lock jamb 26 and into existing stud 30. After lock jamb 26 is installed, the other two plumb anchors (not shown) are checked to make sure they are tight against the studs.

Next, the temporary spreader bar (not shown) may be removed and a trim portion (not shown in unitary form) of door frame assembly 20, which includes hinge jamb trim piece 66, lock jamb trim piece 104, and frame head jamb trim piece 104 may be installed. The trim portion is installed from the non-door side by allowing lock jamb trim piece 104 to slide to the lock jamb side until it stops. Then, hinge jamb trim piece 66 is positioned so that connector portion 68 snaps into and bottoms out in attachment track 60. Next, self drilling sheet metal screws 64' are run through mute holes 116 and into lock jamb trim piece 104 until the trim piece is pulled tightly against door side base 86. Then, sill screws (not shown) are typically inserted through trim pieces 66 and 104 and into existing stud 30 adjacent bottom ends 34 and 78, respectively. Finally, each mute hole 116 is plugged with a rubber mute 118.

A door frame assembly according to the present invention offers advantages over prior art designs in that it may be shipped as a completed door and frame unit with all components assembled, including finish paint, and may be installed in 10 minutes or less. A door frame assembly according to the present invention is typically supplied with welded corners that meet all SDI and NAAMM architectural specifications, and will generally meet all industry standards for physical endurance and fire ratings.

A door frame assembly according to the present invention is easier to install than known systems because it is reversible and may be swapped out with a different assembly at any time allowing recovery from installation errors and accommodation to construction changes. A door frame assembly according to the present invention is easily installed as two total pieces wrapped together from opposite directions and connected together by concealed fasteners. In addition, a door frame assembly according to the present invention may be configured to accept all residential or commercial hardware products.

A door frame assembly according to the present invention offers security advantages over known assemblies. Because the mute holes through which the fasteners are accessed are positioned on a portion of the frame assembly that is covered by the door, the door frame assembly is protected from disassembly when the door is closed and locked.

Although the invention has been described and illustrated with respect to exemplary embodiments thereof, it should be understood by those skilled in the art that the foregoing and various other changes, omissions and additions may be made therein and thereto, without parting from the spirit and scope of the present invention. Accordingly, other embodiments are within the scope of the following claims.

What is claimed is:

1. A door frame assembly for installation with existing studs and wall boards, comprising:

a hinge jamb having a bottom end and a top end;

a hinge jamb trim piece;

a lock jamb having a bottom end and a top end, said lock jamb further comprising a door side base connected to a door contact flange, which is connected to a connection flange, said connection flange adapted to be fastened to said existing studs using fasteners;

a lock jamb trim piece adapted to at least partially cover said connection flange and said fasteners;

a frame head jamb having a hinge jamb end and a lock jamb end, said hinge jamb end joined with said top end of said hinge jamb and said lock jamb end joined with said top end of said lock jamb, said frame head jamb further comprising a door side base connected to a door contact flange, which is connected to a connection flange, said connection flange adapted to be fastened to said existing studs using fasteners;

a frame head jamb trim piece adapted to at least partially cover said connection flange and said fasteners; and a trim attachment bracket sized to fit within at least one of said lock jamb and said frame head jamb, said trim attachment bracket receiving a fastener through at least one of said lock jamb and said frame head jamb and the fastener extending through at least one of said lock jamb trim piece and said frame head jamb trim piece to removably secure at least one of said lock jamb trim piece to said lock jamb and said frame head jamb trim piece to said frame head jamb thereby substantially preventing at least one of said lock jamb trim piece and said frame head jamb trim piece from moving in any direction.

2. A door frame assembly according to claim 1, said hinge jamb further comprising a door side base connected to a door contact flange, which is connected to a non-door side trim attachment track, said non-door side trim attachment track adapted to be fastened to said existing studs using fasteners.

3. A door frame assembly according to claim 2, said hinge jamb trim piece including a connector portion configured to be removably retained within said non-door side trim attachment track, said hinge jamb trim piece adapted to at least partially cover said non-door side trim attachment track and said fasteners.

4. A door frame assembly according to claim 1, wherein said fastener and said fasteners are screw fasteners.

5. A door frame assembly according to claim 1, wherein said trim attachment bracket includes one or more fastener holes for receiving said fastener.

6. A door frame assembly according to claim 1, wherein at least one of said hinge jamb, said lock jamb, said lock jamb trim piece, said frame head jamb, and said frame head trim piece include one or more fastener holes.

7. A door frame assembly for installation with existing studs and walls, comprising:

a hinge jamb adapted to be joined with said existing studs and overlay said existing walls, said hinge jamb having a bottom end and a top end;

a hinge jamb trim piece adapted to overlay said existing walls;

a lock jamb adapted to be joined with said existing studs and overlay said existing walls, said lock jamb further comprising a door side base connected to a door contact flange, which is connected to a connection flange, said connection flange including one or more fastener holes and said connection flange adapted to be fastened to said existing studs using fastening means that extend through said one or more fastener holes;

a lock jamb trim piece adapted to overlay said existing walls, said lock jamb trim piece adapted to at least partially cover said connection flange, said one or more fastener holes, and any fastening means;

a frame head jamb adapted to be joined with said existing studs and overlay said existing walls, said frame head jamb having a hinge jamb end and a lock jamb end, said hinge jamb end being joined with said top end of said hinge jamb and said lock jamb end being joined with said top end of said lock jamb, said frame head jamb further comprising a door side base connected to a door contact flange, which is connected to a connection flange, said connection flange including one or more fastener holes and said connection flange adapted to be fastened to said existing studs using fastening means that extend through said one or more fastener holes;

a frame head jamb trim piece adapted to overlay said existing walls, said frame head jamb trim piece adapted to at least partially cover said connection flange, said one or more fastener holes, and any fastening means; and a trim attachment bracket sized to fit within at least one of said lock jamb and said frame head jamb and receive fastening means through at least one of said lock jamb and said frame head jamb and the fastening means extending through at least one of said lock jamb trim piece and said frame head jamb trim piece to removably secure at least one of said lock jamb trim piece to said lock jamb and said frame head jamb trim piece to said frame head jamb thereby substantially preventing at least one of said lock jamb trim piece and said frame head jamb trim piece from moving in any direction.

8. A door frame assembly according to claim 7, said hinge jamb further comprising a door side base connected to a door contact flange, which is connected to a non-door side trim attachment track, said non-door side trim attachment track including one or more fastener holes and adapted to be fastened to said existing studs using fastening means that extend through said one or more fastener holes.

9. A door frame assembly according to claim 7, said hinge jamb trim piece including a connector portion configured to be removably retained within said non-door side trim attachment track, said hinge jamb trim piece adapted to at least partially cover said non-door side trim attachment track, said one or more fastener holes, and any fastening means.

10. A door frame assembly according to claim 7, further comprising:

fastening means for attaching at least one of said hinge jamb, said lock jamb, and said frame head jamb with at least one of said existing studs and said existing walls.

11. A door frame assembly according to claim 10, wherein said fastening means for attaching include a screw fastener.

12. A door frame assembly according to claim 7, further comprising a screw fastener, wherein said screw fastener and said trim attachment bracket removably secure at least one of said lock jamb trim piece to said lock jamb and said frame head jamb trim piece to said frame head jamb.

* * * * *